US008465120B2

(12) United States Patent
Numata

(10) Patent No.: US 8,465,120 B2
(45) Date of Patent: Jun. 18, 2013

(54) ELECTRONIC DEVICE

(75) Inventor: Taketo Numata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 200 days.

(21) Appl. No.: 13/073,759

(22) Filed: Mar. 28, 2011

(65) Prior Publication Data

US 2011/0310168 A1 Dec. 22, 2011

(30) Foreign Application Priority Data

Jun. 17, 2010 (JP) ..... 2010-138429

(51) Int. Cl.
*B41J 29/393* (2006.01)

(52) U.S. Cl.
USPC ..... 347/19

(58) Field of Classification Search
None
See application file for complete search history.

(56) References Cited

U.S. PATENT DOCUMENTS

2010/0067926 A1* 3/2010 Akiyama et al. ..... 399/21

FOREIGN PATENT DOCUMENTS

| | | |
|---|---|---|
| JP | 2007-055030 A | 3/2007 |
| JP | 2009-018506 A | 1/2009 |
| JP | 2010-064442 A | 3/2010 |

* cited by examiner

*Primary Examiner* — Matthew Luu
*Assistant Examiner* — Justin Seo
(74) *Attorney, Agent, or Firm* — Scully, Scott, Murphy & Presser, P.C.

(57) ABSTRACT

An electronic device, including a carriage conveyance mechanism, a sheet conveyance mechanism, and a controller including: a failure detecting portion configured to detect a carriage conveyance failure; a position detecting portion configured to detect a carriage position of on a carriage conveyance path; a conveyance start position storage portion configured to store a conveyance start position of the carriage; a failure occurrence position identifying portion configured to identify a failure occurrence position; an outer-edge position identifying portion configured to identify a position of an outer edge of a sheet passing area which is an area in the carriage conveyance path; and a jam judging portion configured to judge that the detected conveyance failure is due to a sheet jam where the outer-edge position is present between the conveyance start position stored by the conveyance start position storage portion and the failure occurrence position identified by the failure occurrence position identifying portion.

12 Claims, 8 Drawing Sheets

| SHEET SIZE | CARRIAGE CONVEYANCE DIRECTION | START-POINT POSITION R1 OF SHEET PASSING AREA |
|---|---|---|
| A4 | FORWARD | **** |
| | BACKWARD | **** |
| B5 | FORWARD | **** |
| | BACKWARD | **** |
| A5 | FORWARD | **** |
| | BACKWARD | **** |
| ... | ... | ... |

ELECTRONIC DEVICE

CROSS REFERENCE TO RELATED APPLICATION

The present application claims priority from Japanese Patent Application No. 2010-138429, which was filed on Jun. 17, 2010, the disclosure of which is herein incorporated by reference in its entirety.

BACKGROUND OF THE INVENTION

1. Field of the Invention

The present invention relates to an electronic device.

2. Discussion of Related Art

There has been conventionally known an image forming device configured to convey, in a main scanning direction, a carriage on which ink-jet heads are mounted and to convey a sheet in a sub scanning direction that intersects the main scanning direction, so as to form an image on the sheet. For instance, there is known an image forming device in which the carriage comes to an emergency stop or the carriage is retreated in a direction opposite to a direction in which the carriage has been conveyed up to that time, where a conveyance failure of the carriage is detected. Here, the conveyance failure refers to a state in which an intended result cannot be obtained in a conveyance control during conveyance of the carriage. As a method of detecting the conveyance failure, there is known a method in which a speed of a carriage, a drive current/voltage of a motor, or the like is monitored, and a physical amount thereof is compared with a preset failure judgment value so as to detect the conveyance failure.

SUMMARY OF THE INVENTION

In the conventional method described above, however, there may be a possibility of making a misjudgment, depending upon a conveyance start position of the carriage, that the conveyance failure is due to the jam although the conveyance failure is not due to the jam. More specifically, in the conventional method, where it is judged whether or not the conveyance failure is due to the jam on the basis of the carriage position at the time of detection of the conveyance failure, there may be a possibility of making a judgment that the conveyance failure is due to the jam depending upon the carriage position at the time of detection even where the carriage is already located over the sheet at a time when the conveyance of the carriage is to start and therefore the conveyance failure will not occur. The present invention is made in view of the situations described above. It is therefore an object of the invention to provide an electronic device in which it is possible to appropriately deal with the conveyance failure.

The above-indicated object may be attained according to a principle of the invention, which provides an electronic device, comprising:

a carriage conveyance mechanism configured to convey a carriage in a main scanning direction;

a sheet conveyance mechanism configured to convey a sheet in a sub scanning direction that intersects the main scanning direction; and a controller configured to control operations of the electronic device and including:

a failure detecting portion configured to detect a conveyance failure of the carriage;

a position detecting portion configured to detect a position of the carriage on a carriage conveyance path through which the carriage is conveyed by the carriage conveyance mechanism;

a conveyance start position storage portion configured to store, on the basis of a result of detection by the position detecting portion, a conveyance start position of the carriage at a time when the carriage conveyance mechanism starts to convey the carriage at a standstill in the main scanning direction;

a failure occurrence position identifying portion configured to identify, on the basis of a result of detection by the position detecting portion, a failure occurrence position that is a position of the carriage at a time when the failure detecting portion detects the conveyance failure;

an outer-edge position identifying portion configured to identify a position of an outer edge of a sheet passing area which is an area in the carriage conveyance path and which faces an area in which the sheet conveyed by the sheet conveyance mechanism in the sub scanning direction passes; and a jam judging portion configured to judge whether or not the conveyance failure detected by the failure detecting portion is due to a jam of the sheet, wherein the jam judging portion is configured to judge that the conveyance failure detected by the failure detecting portion is due to the jam where the outer-edge position identified by the outer-edge position identifying portion is present between the conveyance start position stored by the conveyance start position storage portion and the failure occurrence position identified by the failure occurrence position identifying portion.

The above-indicated object may also be attained according to a principle of the invention, which provides an electronic device, comprising:

a carriage conveyance mechanism configured to convey a carriage in a main scanning direction;

a sheet conveyance mechanism configured to convey a sheet in a sub scanning direction that intersects the main scanning direction; and a controller configured to control operations of the electronic device and including:

a failure detecting portion configured to detect a conveyance failure of the carriage;

a position detecting portion configured to detect a position of the carriage on a carriage conveyance path through which the carriage is conveyed by the carriage conveyance mechanism;

a conveyance start position storage portion configured to store, on the basis of a result of detection by the position detecting portion, a conveyance start position of the carriage at a time when the carriage conveyance mechanism starts to convey the carriage at a standstill in the main scanning direction;

a failure occurrence position identifying portion configured to identify, on the basis of a result of detection by the position detecting portion, a failure occurrence position that is a position of the carriage at a time when the failure detecting portion detects the conveyance failure; and an outer-edge position identifying portion configured to identify a position of an outer edge of a sheet passing area which is an area in the carriage conveyance path and which faces an area in which the sheet conveyed by the sheet conveyance mechanism in the sub scanning direction passes, wherein the controller controls the carriage conveyance mechanism to conduct a test conveyance operation in which the carriage is conveyed to pass the failure occurrence position where the outer-edge position identified by the outer-edge position identifying portion is not present between the conveyance start position stored by the conveyance start position storage portion and the failure occurrence position identified by the failure occurrence position identifying portion.

BRIEF DESCRIPTION OF THE DRAWINGS

The above and other objects, features, advantages and technical and industrial significance of the present invention will be better understood by reading the following detailed description of an embodiment of the invention, when considered in connection with the accompanying drawings, in which.

DETAILED DESCRIPTION OF THE EMBODIMENT

Figure 1:
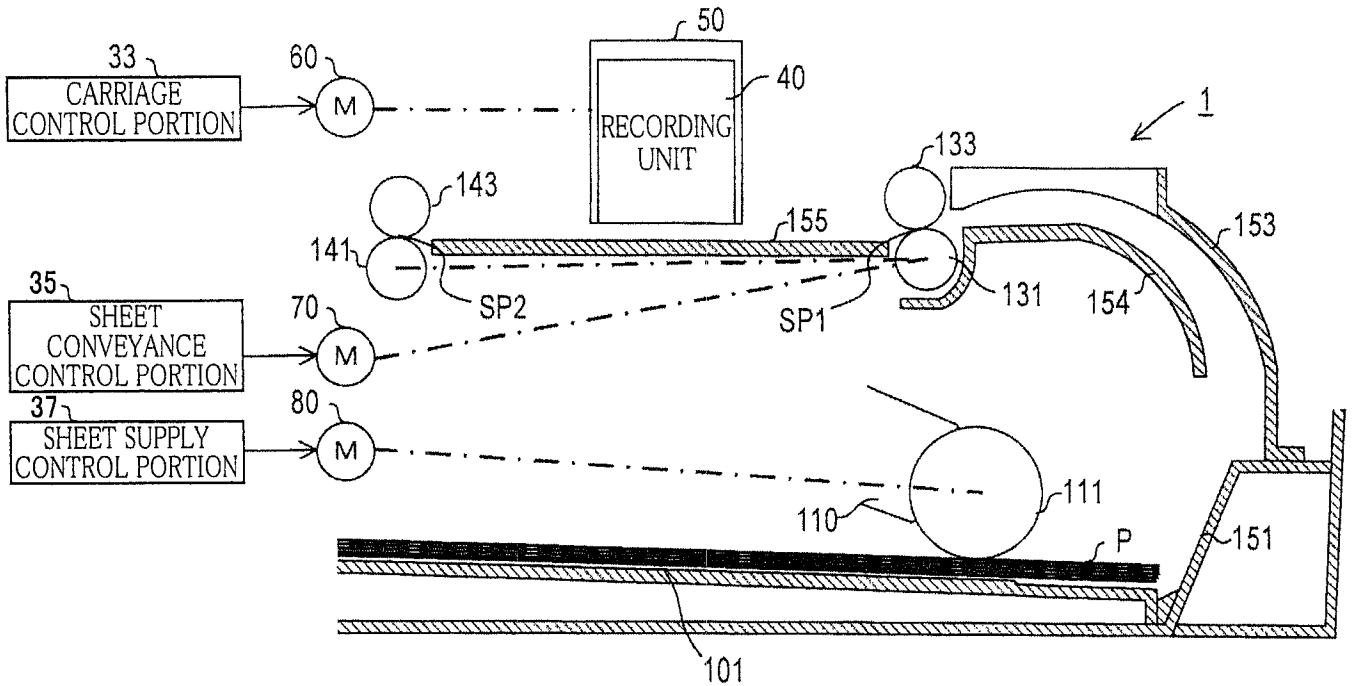
FIG. 1 is a cross-sectional view showing a structure of an image forming device.

There will be hereinafter described one embodiment of the invention with reference to the drawings. An image forming device 1 shown in FIG. 1 according to one embodiment of the present invention is constituted as an ink-jet printer and includes: a sheet tray 101; a sheet supply unit 110 configured to separate sheets P stacked on the sheet tray 101 one by one and to supply the separated sheet P to a sheet conveyance path; a conveyance roller 131 configured to cooperate with a pinch roller 133 to hold the sheet P supplied to the sheet conveyance path by rotation of a sheet supply roller 111 of the sheet supply unit 110 and to convey the sheet P to an ink ejection position below a recording unit 40 by a rotating operation; and a discharge roller 141 configured to cooperate with a pinch roller 143 to hold the sheet P conveyed by the conveyance roller 131 and to discharge the sheet P to a discharge tray (not shown) located downstream of the sheet conveyance path.

The sheet supply unit 110 is configured to separate an uppermost one of the sheets P stacked on the sheet tray 101 so as to feed the sheet P to the sheet conveyance path by the rotation of the sheet supply roller 111. The sheet supply roller 11 rotates by a drive force received from a sheet supply motor 80 constituted by a direct current (DC) motor. An upstream portion of the sheet conveyance path is constituted by elements 151, 153, 154, etc., and regulates a movement of the sheet P supplied by the sheet supply roller 111 so as to guide the sheet P fed from the sheet tray 101 to a contact point SP1 between the conveyance roller 131 and the pinch roller 133 located at a downstream portion of the sheet conveyance path. In the present image forming device 1, when the leading end of the sheet P reaches the contact point SP1 through the sheet conveyance path, the sheet P is inserted between the conveyance roller 131 and the pinch roller 133 by the rotating operation of the conveyance roller 131 and is held or nipped therebetween. Thereafter, as the conveyance roller 131 rotates, the sheet P is conveyed downstream in the sheet conveyance path (in a sub scanning direction) by a distance corresponding to an amount of the rotation of the conveyance roller 131.

A platen 155 which constitutes the downstream portion of the sheet conveyance path connecting the conveyance roller 131 and the discharge roller 141 is configured to guide the sheet P conveyed from the conveyance roller 131 to the ink ejection position at which ink is ejected by the recording unit 40 and to guide the sheet P on which an image has been formed by an ink ejection operation by the recording unit 40 to a contact point SP2 between the discharge roller 141 and the pinch roller 143. The sheet P is conveyed toward the discharge roller 141 along the platen 155. When the leading end of the sheet P reaches the contact point SP2 between the discharge roller 141 and the pinch roller 143, the sheet P is inserted between the discharge roller 141 and the pinch roller 143 by the rotation of the discharge roller 141 so as to be held or nipped by the discharge roller 141 and the pinch roller 143. Thereafter, as the discharge roller 141 rotates, the sheet P is discharged to the discharge tray not shown. The conveyance roller 131 rotates by a drive force received from an LF motor 70 constituted by a DC motor. The discharge roller 141 and the conveyance roller 131 have the same diameter and are connected to each other by a belt, and the discharge roller 141 rotates together with the conveyance roller 131 in an interlocking manner.

Figure 2:
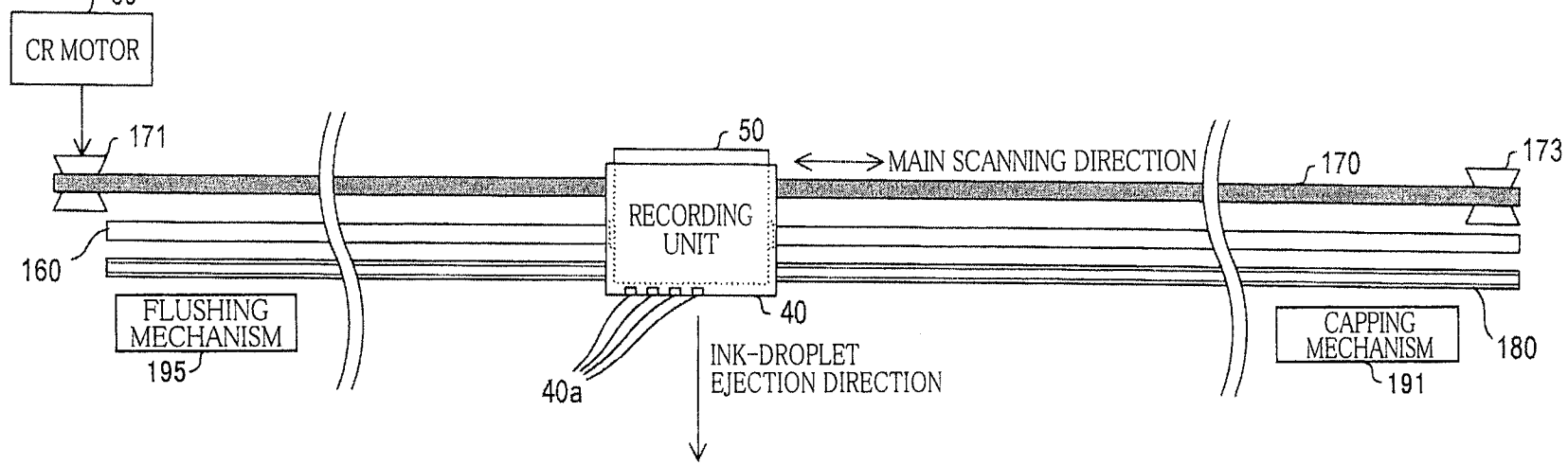
FIG. 2 is a view showing a structure of a carriage conveyance mechanism.
Figure 3:
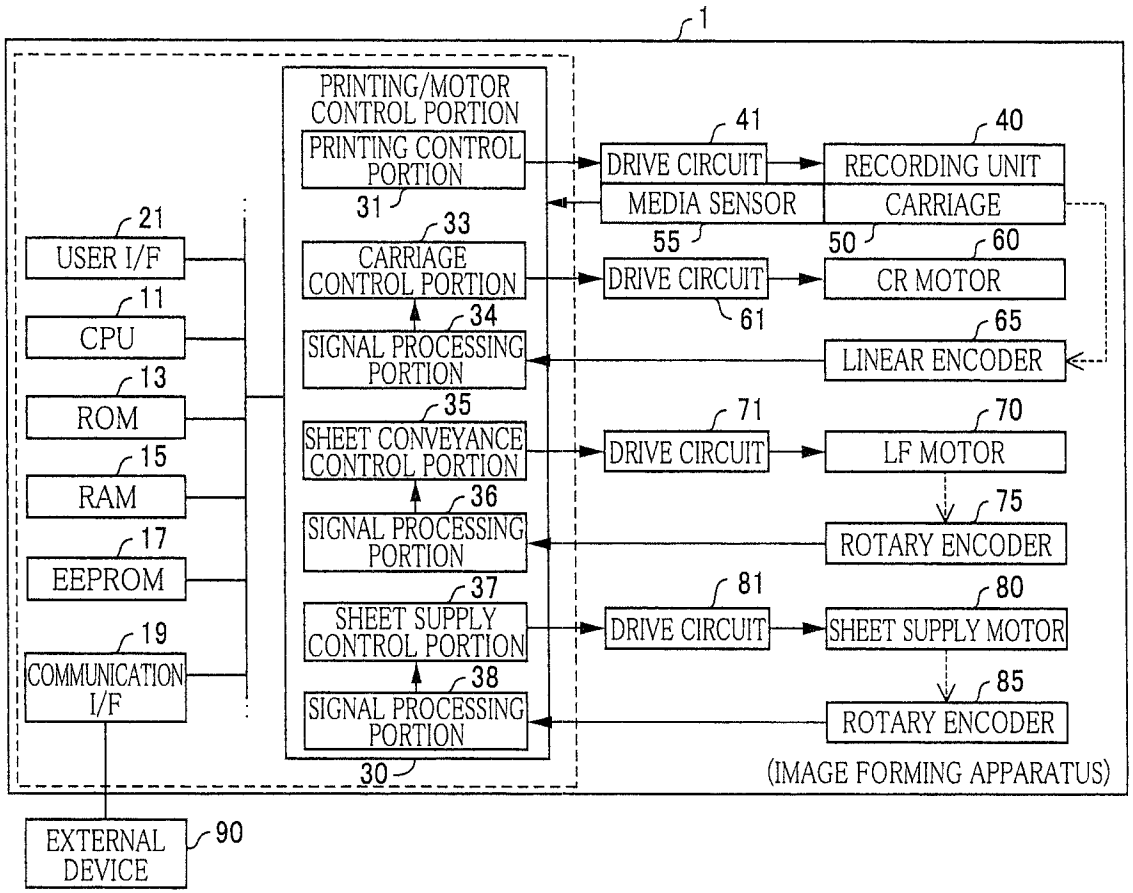
FIG. 3 is a block diagram showing an electric structure of the image forming device.

The recording unit 40 has nozzles 40*a* from which ink droplets are ejected and which are arranged on its bottom surface facing the platen 155. It is noted that the nozzles 40*a* are conceptually shown in FIG. 2 and are formed in a way similar to that in known ink-jet heads. The recording unit 40 is mounted on a carriage 50 which is movable in a main scanning direction, i.e., in a direction perpendicular to the sheet plane of FIG. 1. The carriage 50 is driven by a CR motor 60 constituted by a DC motor so as to move in the main scanning direction. As shown in FIG. 2, a carriage conveyance mechanism is configured such that the carriage 50 connected to an endless belt 170 is movable along a guide shaft 160 extending in the main scanning direction. The endless belt 170 is stretched between a pulley 171 and a pulley 173. The pulley 171 is configured to rotate by a drive force received from the CR motor 60. The endless belt 170 rotates by the drive force of the CR motor 60 received via the pulley 171. The carriage 50 moves in the main scanning direction along the guide shaft 160 in accordance with the rotary movement of the endless belt 170 which is caused by the drive force received from the CR motor 60. The image forming device 1 is equipped with a linear encoder 65 (FIG. 3). As a constituent element of the linear encoder 65, there is provided a timing slit 180 in which slits are formed at constant minute intervals along the guide shaft 160, as shown in FIG. 2. There is provided, on the carriage 50, a sensor element not shown configured to read the intervals of the slits and to output pulse signals (encoder signals) each corresponding to the position of the carriage 50.

At one of opposite ends of a carriage conveyance path along the guide shaft 160, which one end is nearer to a home position (HP), there is provided a capping mechanism 191 configured to put a cap on the bottom surface of the recording unit 40 for capping. Here, the carriage conveyance path refers to an area extending in the main scanning direction in which the carriage 50 is movable along the guide shaft 160. The capping mechanism 191 is configured to move the cap downward when the carriage 50 is moved away from the home position and to mechanically push the cap upward gradually by a pressing force of the carriage 50 when the carriage 50 approaches toward the home position. At a time when the carriage 50 reaches the home position, the cap is put on the bottom surface of the recording unit 40 from the lower side of the recording unit 40 to complete the capping. At the other of the opposite ends of the carriage conveyance path remote from the home position, there is provided a flushing mechanism 195 configured to receive and absorb ink ejected from the recording unit 40. Hereinafter, the position on the carriage conveyance path at which the flushing mechanism 195 is provided is referred to as a flushing position. The image forming device 1 of the present embodiment is configured to supply sheets having a size not larger than an A4 size, and the length of the carriage conveyance path in the main scanning direction is set to be sufficiently longer than the width of the A4-size sheet.

Referring next to FIG. 3, there will be explained an electric structure of the image forming device 1. In addition to the constituent components described above, the image forming device 1 includes: a CPU 11; a ROM 13 for storing programs to be executed by the CPU 11; a RAM 15 utilized as a work area when the CPU 11 executes the programs; an EEPROM 17 for storing various setting information; a communication interface (I/F) 19 for receiving print image data transmitted from an external device 90; a user interface (I/F) 21 including various operation keys, a display for displaying messages, and a speaker; a printing/motor control portion 30; drive circuits 41, 61, 71, 81 for driving the recording unit 40, the CR motor 60, the LF motor 70, and the sheet supply motor 80, respectively; rotary encoders 75, 85; and a media sensor 55. The printing/motor control portion 30 includes: a printing control portion 31; a carriage control portion 33; a sheet conveyance control portion 35; a sheet supply control portion 37; and signal processing portions 34, 36, 38. In the present image forming device 1, the components enclosed by a broken line in FIG. 3 constitute a controller.

The printing control portion 31 is configured to control the ink-droplet ejection operation of the recording unit 40. The printing control portion 31 drives the recording unit 40 through the drive circuit 41 in accordance with a command inputted from the CPU 11 so as to control the ink-droplet ejection operation of the recording unit 40. Thus, the printing control portion 31 controls the recording unit 40 to form, on the sheet P, an image based on the print image data inputted from the CPU 11. The carriage control portion 33 is configured to drive the CR motor 60 through the drive circuit 61 and to execute a conveyance control of the carriage 50 by controlling a drive voltage or current of the CR motor 60. Where an image is formed on the sheet P by the ink droplets, for instance, the carriage 50 is conveyed at a constant speed to permit the ink droplets to be attached to or landed on a target position. The carriage control portion 33 executes the above-indicated conveyance control of the carriage 50 in accordance with a command from the CPU 11. Further, to the carriage control portion 33, there is inputted information on a position X and a speed V of the carriage 50 from the signal processing portion 34 for the above-indicated conveyance control. The signal processing portion 34 is configured to process the encoder signals (A-phase signals and B-phase signals) inputted from the linear encoder 65 and to thereby detect the position X and the speed V of the carriage 50. The method of detecting the position X and the speed V of the carriage 50 utilizing the encoder signals are known in the art and an explanation thereof is dispensed with.

The sheet conveyance control portion 35 is configured to control conveyance of the sheet P by controlling the LF motor 70 through the drive circuit 71 in accordance with a command from the CPU 11. In the present invention, a sheet conveyance mechanism is constituted by the sheet conveyance control portion 35, the conveyance roller 131, and so on. To the sheet conveyance control portion 35, there is inputted, from the signal processing portion 36, information on an amount and a speed of conveyance of the sheet P. The rotary encoder 75 is provided on a rotation shaft of the LF motor 70, and the signal processing portion 36 detects the conveyance amount and speed of the sheet on the basis of the encoder signals inputted from the rotary encoder 75 and inputs the information to the sheet conveyance control portion 35. The sheet supply control portion 37 is configured to control the sheet supply motor 80 through the drive circuit 81 in accordance with a command from the CPU 11, thereby realizing a supplying operation of the sheet P from the sheet tray 101 to the conveyance roller 131. To the sheet supply control portion 37, there is inputted, from the signal processing portion 38, the information on the amount and the speed of conveyance of the sheet P. The rotary encoder 85 is provided on a rotation shaft of the sheet supply motor 80, and the signal processing portion 38 detects the amount and the speed of conveyance of the sheet on the basis of the encoder signals inputted from the rotary encoder 85 and inputs the information to the sheet supply control portion 37.

The CPU 11 inputs commands to each portion of the printing/motor control portion 30 constructed as described above so as to generally control an image forming operation in the main scanning direction and a conveyance operation of the sheet P in the sub scanning direction perpendicular to the main scanning direction, thereby forming, on the sheet P, an image based on the print image data inputted from the external device 90. When a conveyance failure is detected by the carriage control portion 33 during conveyance of the carriage in association with the image forming operation, the CPU 11 judges whether or not the conveyance failure is due to a jam and executes processing (print control processing) corresponding to the conveyance failure that has occurred, in accordance with the judgment result.

Figure 4:
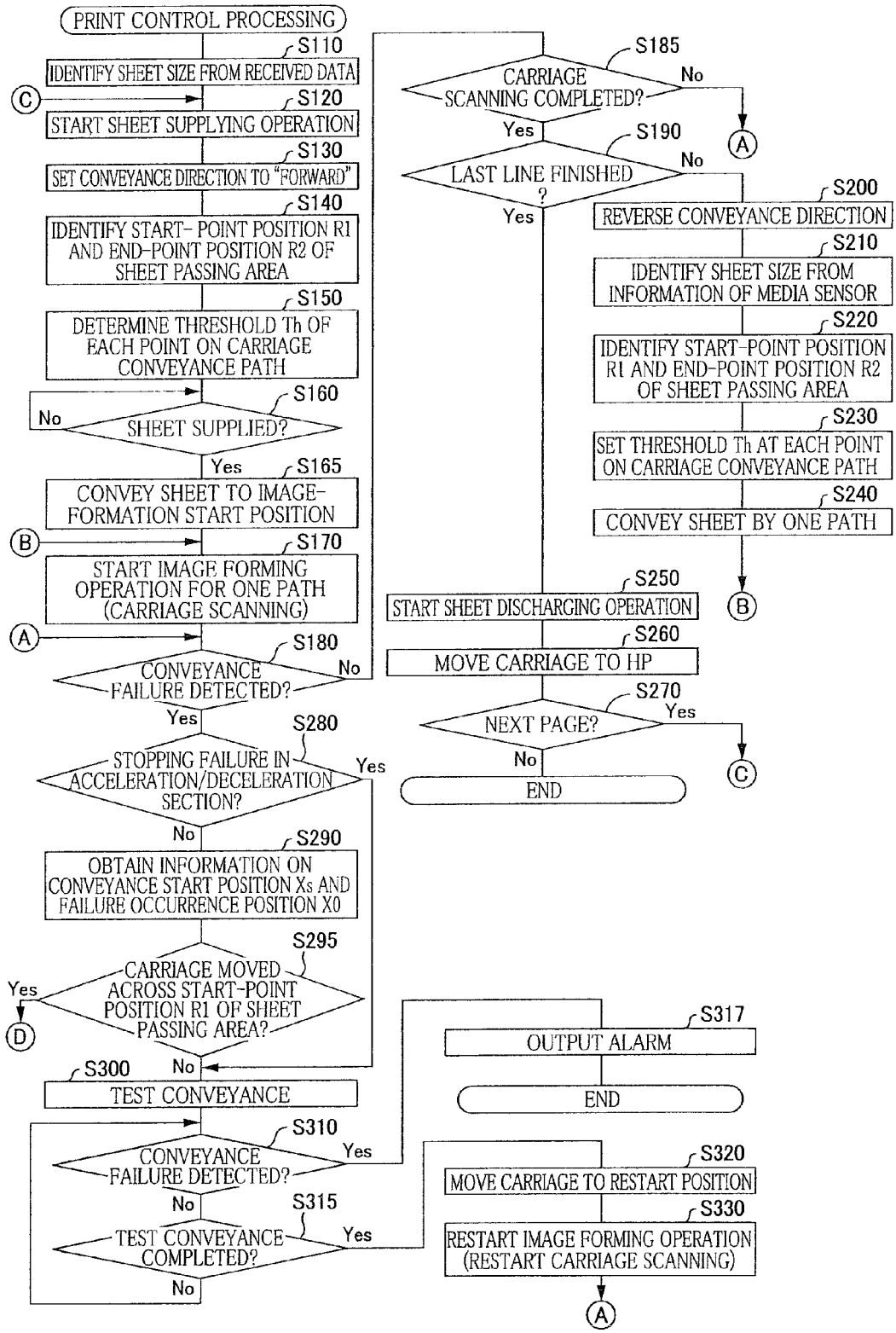
FIG. 4 is a flow chart showing a print control processing executed by a CPU.
Figure 5:
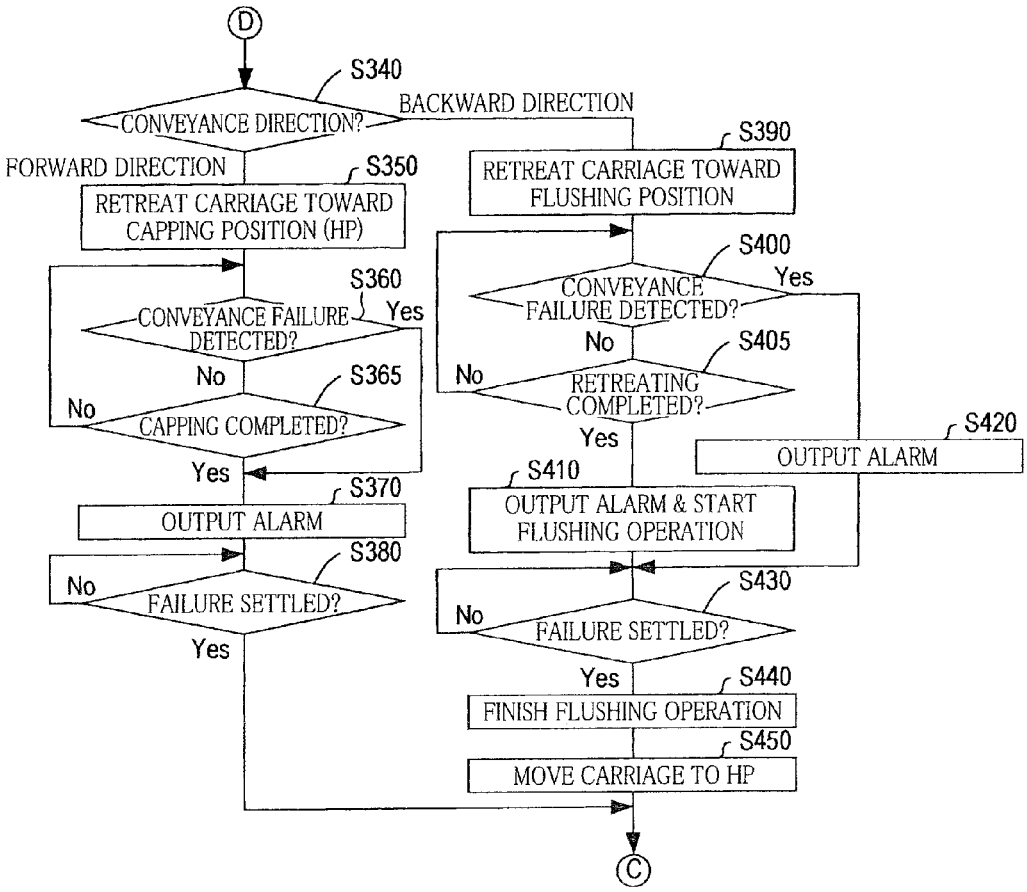
FIG. 5 is a flow chart showing a print control processing executed by the CPU.

The print control processing executed by the CPU 11 will be explained. When the CPU 11 receives the print image data together with a print command from the external device 90 via the communication interface 19, the CPU 11 starts the print control processing shown in FIGS. 4 and 5. When the print control processing is started, the CPU 11 identifies the size of the sheet supplied from the sheet tray 101 on the basis of the data received from the external device 90 (S110). The external device 90 is configured to obtain information on the sheet size such as A4, B5, or A5 from a user through a print setting screen and to transmit, as print setting data, the obtained information, together with the print command and the print image data. The CPU 11 identifies in S110 the size of the sheet supplied from the sheet tray 101 on the basis of the information indicated by the above-described print setting data received together with the print image data.

Subsequently, the CPU 11 inputs a command to the sheet supply control portion 37 so as to permit a sheet supplying operation by the sheet supply unit 110 is to be started (S120). Further, the CPU 11 sets a conveyance direction of the carriage to "forward" (S130). In the present embodiment, a direction which is the main scanning direction and which heads from the home position to the flushing position is referred to as "forward" while a direction which is the main scanning direction and which heads from the flushing position to the home position is referred to as "backward".

After S130, the control flow goes to S140 in which there are identified, on the basis of the currently set carriage conveyance direction and the identified sheet size, a start-point position R1 and an end-point position R2 of a sheet passing area which is an area in the carriage conveyance path and in which the sheet P passes. The sheet P moves below the carriage conveyance path along the platen 155. Here, there are identified the start-point position R1 and the end-point position R2 of an area on the carriage conveyance path that faces an area of the platen 155 on which the sheet P passes. The start-point position R1 is an outer edge of the sheet passing area of the carriage conveyance path and is a position of an upstream-side one of two outer edges (two outer ends) of the sheet passing area which are located on an upstream side and a downstream side in the sheet passing area in the carriage conveyance direction. The end-point position R2 is a position of a downstream-side one of the above-indicated two outer edges.

Figure 6:
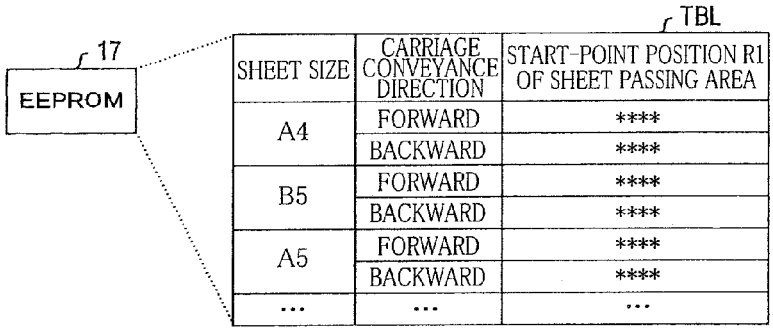
FIG. 6 is a diagram showing a constitution of a position table.

As shown in FIG. 6, the EEPROM 17 stores a position table TBL in which are written the above-indicated start-point positions R1 for each of the respective sheet sizes and for each of the respective carriage conveyance directions. The CPU 11 refers to the position table TBL and identifies the start-point position R1 of the sheet passing area corresponding to the sheet size identified in S110 and the currently set carriage conveyance direction. The CPU 11 further identifies, as the end-point position R2 of the sheet passing area, a position which is located downstream in the carriage conveyance direction from the start-point position R1 indicated in the position table TBL by a distance corresponding to the sheet size. It is noted that the carriage conveyance direction is always set to "forward" in S140. Accordingly, the CPU 111 refers in S140 to the start-point position R1 for the forward direction in the position table TBL. In this regard, the start-point position R1 for the backward direction written in the position table TBL is referred to in processing of S220 (which will be later explained) when the carriage conveyance direction is reversed and set to "backward" in S200. The details will be explained.

Figure 7A:
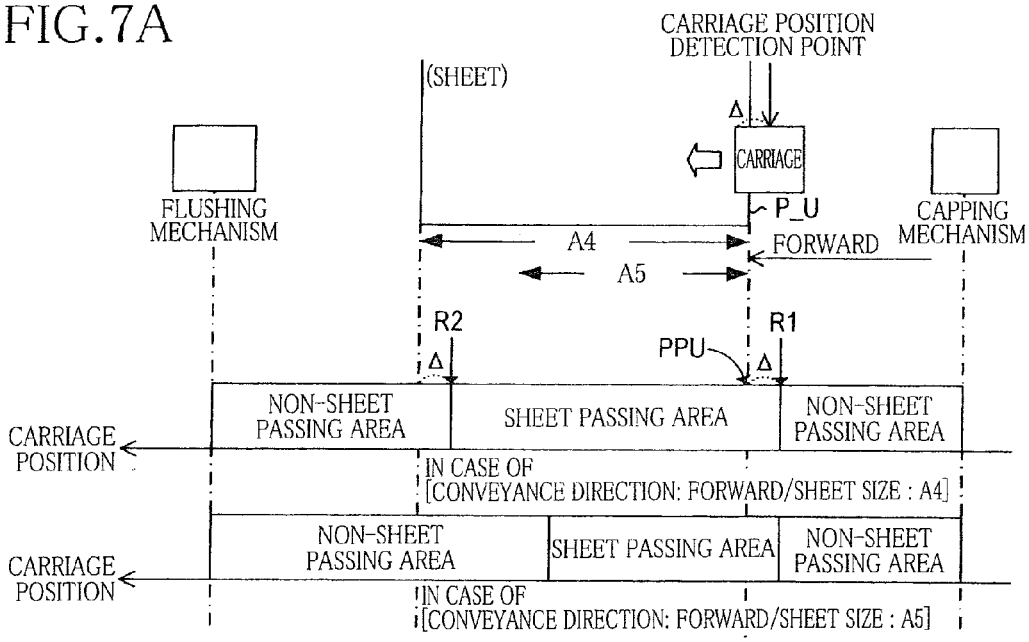
FIG. 7 is a diagram showing a start-point position R1 of a sheet passing area indicated in the position table.
Figure 7B:
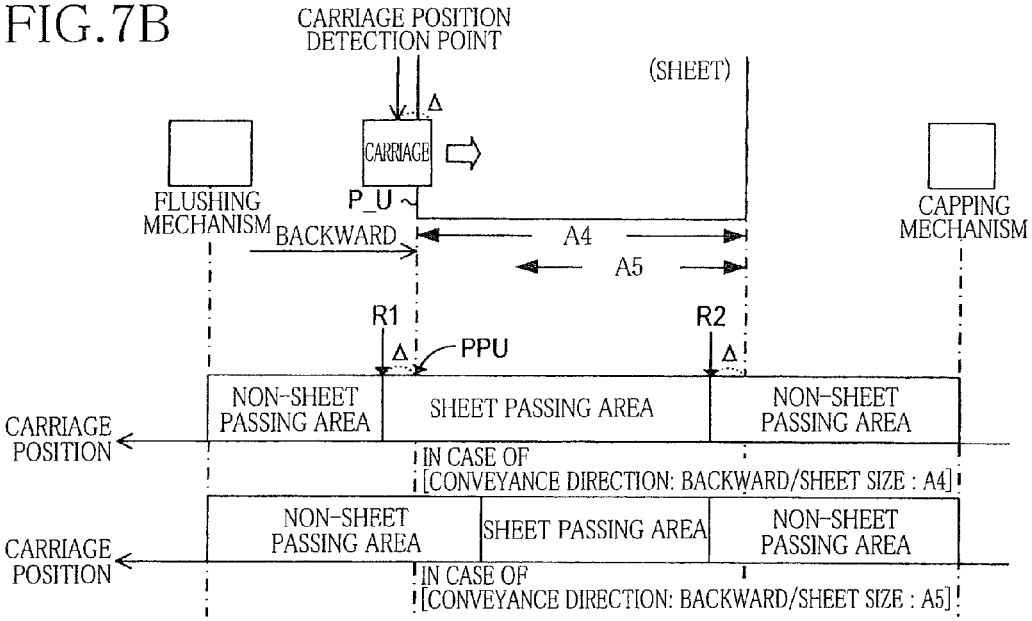

A supplementary explanation on the position table TBL will be given. A shown in FIG. 7, each start-point position R1 indicated in the position table TBL is set to a value that is determined by taking account of the installation position of the linear encoder 65. The sensor element constituting the linear encoder 65 of the image forming device 1 is provided at a central position of the carriage 50 in the main scanning direction, and a carriage-position detection point (FIG. 7) is accordingly located at the central position of the carriage 50 in the main scanning direction. That is, the position X of the carriage 50 obtained from the signal processing portion 34 deviates or is shifted by Δ from the leading end position of the carriage 50. Accordingly, the start-point position R1 indicated in the position table TBL is defined as a position coordinate of a point that is shifted upstream in the carriage conveyance direction by Δ from a point PPU on the carriage conveyance path on which a side edge P_U of the sheet P on the upstream side in the carriage conveyance direction passes. FIG. 7A shows a position coordinate indicated by the position table TBL as the start-point position R1 of the sheet passing area when the carriage conveyance direction is the forward direction while FIG. 7B shows a position coordinate indicated by the position table TBL as the start-point position R1 of the sheet passing area when the carriage conveyance direction is the backward direction. As shown in FIG. 7, the start-point position R1 is set to a position at which the leading end of the carriage 50 contacts the edge of the sheet P.

After the processing in S140, the control flow goes to S150 in which a threshold Th for each of local points on the carriage conveyance path is determined. When the carriage is conveyed at a constant speed, the carriage control portion 33 calculates a deviation e (=Vr−V) between a target speed Vr and an actual speed V of the carriage 50 that is obtained from the signal processing portion 34 and detects a conveyance failure where the deviation e exceeds the threshold Th. The threshold Th determined in S150 is a parameter that influences detection sensitivity of the conveyance failure. In the present embodiment, since it is impossible to obtain position information with higher accuracy than the position X obtained from the signal processing portion 34, the threshold Th of each local point on the carriage conveyance path is determined by setting the threshold Th for every minimum unit of the position X obtained from the signal processing portion 34.

Figure 8A:
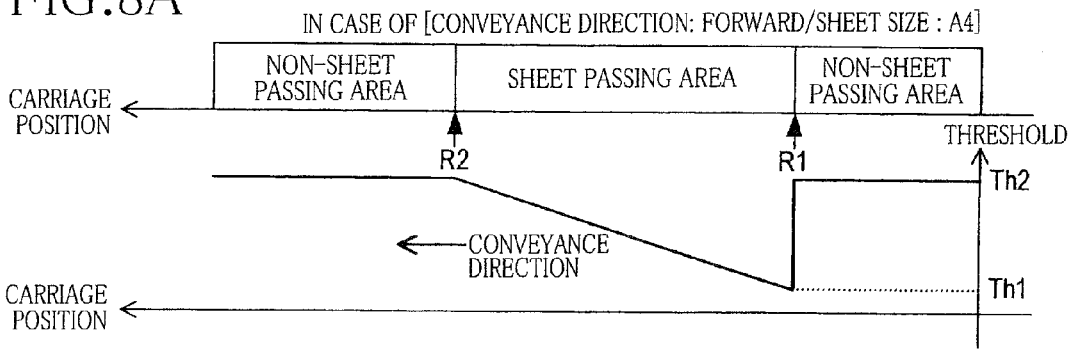
FIG. 8 is a diagram showing a method of setting a threshold.
Figure 8B:
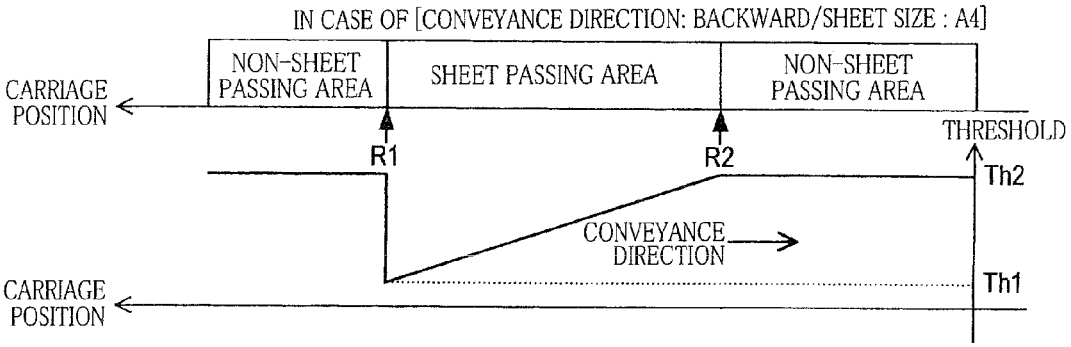

More specifically, as shown in FIG. 8, the threshold Th of the start-point position R1 identified in S140 is set to a first threshold Th1 determined in advance at the design stage, the threshold Th of the end-point position R2 identified in S140 is set to a second threshold Th2 which is determined in advance at the design stage and which is larger than the first threshold Th1, and the thresholds Th of the respective local points within the sheet passing area between the start-point position R1 and the end-point position R2 are set to respective values obtained by linear interpolations on the basis of the first threshold Th1 at the start-point position R1 and the second threshold Th2 at the end-point position R2. In other words, the thresholds Th of the respective local points within the sheet passing area are set so as to linearly increase from the start-point position R1 toward the end-point position R2. Further, the threshold of each of local points outside the sheet passing area is set to the same value as the second threshold Th2 at the end-point position R2. FIG. 8A shows the thresholds Th where the carriage conveyance direction is "forward" while FIG. 8B shows the thresholds Th where the carriage conveyance direction is "backward".

More specifically, the reason for setting the threshold Th as described above is as follows. With regard to the conveyance failure due to the jam, the nozzle portion of the recording unit 40 may be damaged if detection of the conveyance failure is delayed and the carriage 50 is continued to be forcibly conveyed. In view of this, it is preferable to quickly detect the conveyance failure with high sensitivity and to stop conveyance of the carriage 50, in particular where the electronic device is the ink-jet printer. On the other hand, detection of the conveyance failure which arises from a slight increase in the conveyance load due to stains of the guide shaft 160 or the like is preferably avoided wherever possible because such detection undesirably causes the carriage 50 to come to an emergency stop although there is no need to stop the carriage 50. For this reason, in the present embodiment, the threshold Th1 of the start-point position R1 at which the conveyance failure due to the jam is likely to occur is set to the smallest value in the carriage conveyance path so as to maximize the detection sensitivity of the conveyance failure, thereby making it possible to detect the failure with a small deviation e. Further, by gradually lowering the detection sensitivity, namely, by gradually increasing the threshold Th, from the start-point position R1 toward the downstream side in the carriage conveyance direction, the conveyance failure due to the slight increase in the conveyance load is detected with low sensitivity. The thresholds Th1, Th2 may be suitably determined by a design engineer on the basis of such design philosophy.

After the processing in S150, the CPU 11 stands by until the sheet supplying operation started in S120 is completed (S160). When the sheet supplying operation is completed (S160: Yes), the CPU 11 inputs a command to the sheet conveyance control portion 35 so as to permit the sheet conveyance portion 35 to convey the supplied sheet P such that an image-formation start portion (a start line) thereof reaches the ink ejection position at which ink is ejected by the recording unit 40 (S165). Thereafter, the CPU 11 inputs a command to the printing/motor control portion 30 so as to permit the printing/motor control portion 30 to start an image forming operation for one path (S170). The "image forming operation for one path" is an operation of forming, on the sheet P, an image of a predetermined number of lines (e.g., one line) by moving the carriage in the conveyance direction for one way while permitting the recording unit 40 to eject the ink droplets. For instance, in S170, there is inputted, to the printing control portion 31, the received print image data of the line for which an image is to be formed by the printing control portion 31. Further, in S170, by permitting the carriage control portion 33 to convey the carriage 50 in the carriage conveyance direction set in the previous step (S130 or S200), the image forming operation for one path is started by the printing/motor control portion 30.

Figure 9A:
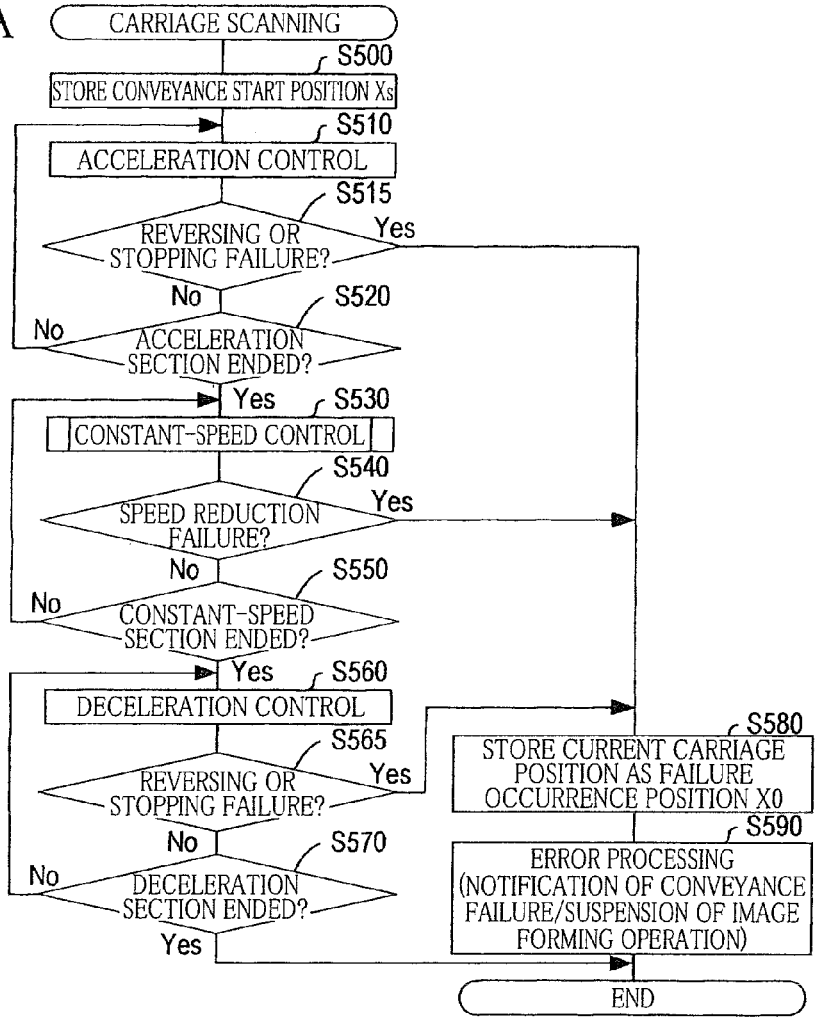
FIG. 9 is a flow chart showing processing executed by a carriage control portion.

Here, the explanation of the print control processing is temporarily suspended, and there will be explained processing to be executed by the carriage control portion 33 by a command inputted from the CPU 11 in S170. FIG. 9A is a flow chart showing the processing executed by the carriage control portion 33 when received the command from the CPU 11 in S170. When the carriage control portion 33 receives the above-indicated command from the CPU 11, the carriage control portion 33 initially stores, in an internal memory, the current position X of the carriage 50 obtained from the signal processing portion 34 as a conveyance start position Xs (S500), and subsequently executes an acceleration control of the carriage 50 repeatedly until an acceleration section ends (S510, S520). For instance, the carriage control portion 33 calculates an operation amount u for the CR motor 60 on the basis of the actual speed V of the carriage 50 obtained from the signal processing portion 34, such that the speed V follows a target speed gradation of the acceleration section designated from the CPU 11. The thus calculated operation amount u is inputted to the drive circuit 61, whereby the CR motor 60 is driven by the drive circuit 61 with a drive voltage or a drive current corresponding to the operation amount u. Thus, the acceleration control following the target speed gradation is realized. In this way, the carriage 50 is accelerated in the acceleration section up to the target speed Vr in a constant-speed section.

In course of the repeatedly executed acceleration control described above, it is judged whether one of a reversing failure and a stopping failure is occurring (S515). The reversing failure means a failure that the carriage 50 reverses or retreats, namely, the carriage 50 moves to a direction opposite to the conveyance direction. The stopping failure means a failure that the carriage 50 stops. Where the reversing failure or the stopping failure is occurring (S515: Yes), S580 is implemented to store, in an internal memory, the current carriage position X obtained from the signal processing portion 34 as a failure occurrence position X0 (S580) and S590 is subsequently implemented to perform error processing (S590) in which the CPU 11 is notified of detection of the conveyance failure and the ink ejecting operation by the printing control portion 31 is suspended. In addition, the conveyance control of the carriage 50 is suspended, and the processing shown in FIG. 9A is ended.

Figure 9B:
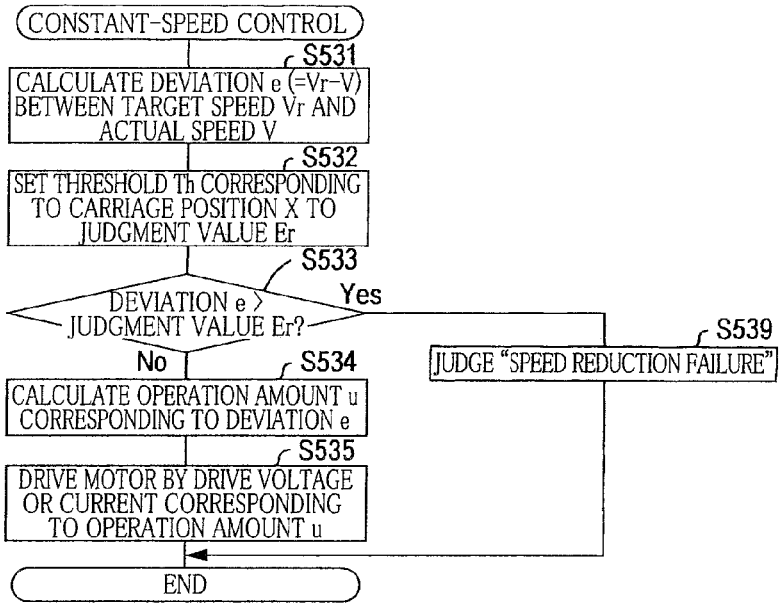

In the meantime, where the acceleration section normally ends (S520: Yes), the control flow goes to S530 in which the carriage control portion 33 executes a constant-speed conveyance control shown in FIG. 9B repeatedly until the constant-speed section ends (S530, S550). FIG. 9B is a flow chart showing processing to be executed by the carriage control portion 33 in S530. In the constant-speed control, there is initially calculated a deviation e (=Vr−V) between a target speed Vr in the constant-speed section and an actual speed V of the carriage 50 obtained from the signal processing portion 34 (S531). After the calculation of the deviation e, the threshold Th which was set by the CPU 11 in the previous step (S150 or S230) and which is a threshold at a point corresponding to the current position X of the carriage 50 obtained from the signal processing portion 34 is set to a failure judgment value Er (S532). Subsequently, it is judged whether or not the deviation e exceeds the failure judgment value Er (S533). Where it is judged that the deviation e is not greater than the failure judgment value Er (S533: No), the operation amount u corresponding to the deviation e is calculated (S534). The calculated operation amount u is inputted to the drive circuit 61, whereby the CR motor 60 is driven by the drive circuit 61 with a drive voltage or a drive current corresponding to the operation amount u, and the speed of the carriage 50 in the main scanning direction is feedback controlled so at to coincide with the target speed Vr. Where the deviation e is not greater than the failure judgment value Er (S533: No), it is judged in S540 that a speed reduction failure is not occurring (S540: No), and the carriage control portion 33 executes the constant-speed control (S530) repeatedly until the constant-speed section ends.

On the other hand, where the deviation e exceeds the failure judgment value Er (S533: Yes), it is judged that the speed reduction failure is occurring (S539, S540: Yes), and the control flow goes to S580 in which the carriage control portion 33 stores, as the failure occurrence position X0, the current carriage position X obtained from the signal processing portion 34 (S580), and the above-indicated error processing is performed (S590) to notify the CPU 11 of detection of the conveyance failure. Further, the ink ejection operation by the carriage control portion 31 is suspended, and the carriage 50 is decelerated/stopped. Thus, the processing shown in FIG. 9A is ended.

In the meantime, where the constant-speed section normally ends (S550: Yes), the control flow goes to S560 in which the carriage control portion 33 executes a deceleration control repeatedly until a deceleration section ends (S560, S570). In S560, the operation amount u for the CR motor 60 is calculated on the basis of the actual speed V of the carriage 50 obtained from the signal processing portion 34, such that the speed V follows a target speed gradation in the deceleration section designated from the CPU 11. The thus calculated operation amount u is inputted to the drive circuit 61, whereby the CR motor 60 is driven by the drive circuit 61 with a drive voltage or a drive current corresponding to the operation amount u. Thus, the conveyance control of the carriage 50 is executed in the deceleration section until the carriage 50 stops. When the deceleration section ends (S570: Yes), the processing shown in FIG. 9A is completed.

In course of the repeatedly executed deceleration control described above, it is judged whether or not one of the reversing failure in which the carriage 50 retreats in a direction opposite to the conveyance direction and the stopping failure in which the carriage 50 stops is occurring, on the basis of the position of the carriage 50 obtained from the signal processing portion 34. Where the reversing failure or the stopping failure is occurring (S565: Yes), S580 is implemented to store, as the failure occurrence position X0, the current carriage position X obtained from the signal processing portion 34 and S590 is subsequently implemented to perform the above-indicated error processing (S590). Thus, in the present embodiment, where the conveyance failure is detected, the carriage conveyance control is temporarily suspended and the "image forming operation for one path" is temporarily suspended.

Description goes back to the printing control processing (FIG. 4) executed by the CPU 11. After initiation of the "image forming operation for one path" in S170, the CPU 11 stands by until the conveyance failure is detected by the carriage control portion 33 or the conveyance control of the carriage 50 is normally completed (S180, S185 in FIG. 4). Where the conveyance control of the carriage 50 is normally completed (S185: Yes) without detection of the conveyance failure (i.e., without receiving notification of the detection of the conveyance failure), S190 is implemented to judge whether or not the "image forming operation for one path" has been conducted till the last line of a first page. Where it is judged that the "image forming operation for one path" is not yet conducted till the last line (S190: No), the carriage conveyance direction is reset to a direction opposite to the currently set direction (S200). That is, when the carriage conveyance direction is currently set to "forward", the carriage conveyance direction is rest to "backward". When the carriage conveyance direction is currently set to "backward", the carriage conveyance direction is reset to "forward". By thus reversing the carriage conveyance direction, the image forming device 1 of the present embodiment reciprocatingly moves the carriage 50.

Where the carriage conveyance direction is reset (S200), the size of the sheet supplied from the sheet tray 101 is identified (S210) on the basis of a detection signal of each of the edges (the outer edges) of the sheet obtained from the media sensor 55 during the immediately preceding carriage conveyance. The media sensor 55 is a known sensor including a light emitting element and a light receiving element and configured to detect a facing member on the basis of light reflected by the facing member. The media sensor 55 is provided integrally with the carriage 50 at a position where the media sensor 55 can face the sheet P that is being conveyed and is configured to move together with the carriage 50 so as to detect each edge of the sheet P parallel to the sub scanning direction when the media sensor 55 passes over the edge. In S210, the sheet size is identified on the basis of the position X of the carriage 50 at a time when each of the two edges of the sheet P parallel to the sub scanning direction is detected. The sheet size identified in S110 is the sheet size notified from the external device 90, and it is not assured that the sheet size coincides with the size of the sheet P actually supplied from the sheet tray 101. Accordingly, in S210, the size of the actually supplied sheet P is identified to enhance jam judging accuracy. It is noted that the processing in S210 may be executed only once after the sheet has been supplied.

Thereafter, the CPU 11 identifies the start-point position R1 and the end-point position R2 of the sheet passing area corresponding to the current carriage conveyance direction on the basis of the sheet size re-identified in S210 and the presently set carriage conveyance direction, as in the processing in S140 (S220). Further, on the basis of the thus identified the start-point position R1 and the end-point position R2 of the sheet passing area, the threshold Th at each point on the carriage conveyance path is set in a manner similar to that in S150 (S230). After the processing in S230, S240 is implemented in which the CPU 11 inputs a command to the sheet conveyance control portion 35, whereby the sheet P is conveyed downstream in the conveyance direction by the sheet conveyance control portion 35 by a distance corresponding to one path. Here, the "distance corresponding to one path" corresponds to a length in the sub scanning direction of an image that can be formed on the sheet P by the "image forming operation for one path" in S170. After this processing, the control flow goes to S170 in which the CPU 11 controls the printing/motor control portion 30 to start the "image forming operation for one path", and thereafter S180 and the subsequent steps are implemented.

When the image forming operation to the last line is completed (S190: Yes), S250 is implemented in which a command is inputted to the sheet conveyance control portion 35, thereby permitting the sheet conveyance control portion 35 to perform processing of discharging the sheet P to the discharge tray. Thereafter, S260 is implemented to move the carriage 50 to the home position by the carriage control portion 33. Further, the CPU 11 judges whether or not there exists next-page data in the print image data received from the external device 90 (S270). Where it is judged that the next-page data exists (S270: Yes), the processing in S120 and the subsequent steps is performed for the next-page data. Where it is judged that the next-page data does not exist, the print control processing is ended.

In the meantime, where the conveyance failure is detected by the carriage control portion 33 during execution of the "image forming operation for one path" and the detection of the conveyance failure is notified (S180: Yes), the CPU 11 judges whether or not the detected conveyance failure is due to an occurrence of the stopping failure in the acceleration section or the deceleration section (S280). Where the detected conveyance failure is due to the occurrence of the stopping failure (S280: Yes), it is judged that the detected conveyance failure is not due to a jam, but due to a load increase caused by other reasons, and the control flow goes to S300. On the other hand, where the conveyance failure detected by the carriage control portion 33 is not due to the occurrence of the stopping failure in the acceleration section or the deceleration section (S280: No), the control flow goes to S290.

In S290, the CPU 11 obtains, from the carriage control portion 33, information on the conveyance start position Xs and the failure occurrence position X0 as information on the current carriage conveyance in which the conveyance failure has been detected. On the basis of the conveyance start position Xs and the failure occurrence position X0, it is judged whether or not the carriage 50 has moved across the start-point position R1 of the sheet passing area in the current carriage conveyance according to the processing in S170 (S295). More specifically, it is judged whether or not the carriage 50 has moved across the start-point position R1 of the sheet passing area depending upon whether the start-point position R1 of the sheet passing area exists in an area of the carriage conveyance path interposed between the conveyance start position Xs and the failure occurrence position X0. Where the start-point position R1 does not exist between the conveyance start position Xs and the failure occurrence position X0 and accordingly the carriage 50 has not moved across the start-point position R1 (S295: No), it is judged that the conveyance failure is not due to the jam, and the control flow goes to S300. On the other hand, where the start-point position R1 exists between the conveyance start position Xs and the failure occurrence position X0 and accordingly the carriage has moved across the start-point position R1 (S295: Yes), it is judged that the conveyance failure is due to the jam, and the control flow goes to S340. As mentioned above, the start-point position R1 is a position of the upstream-side outer edge of the sheet passing area in the carriage conveyance direction. In the image forming device 1 wherein the conveyance failure due to the jam is judged depending upon whether the position of the upstream-side outer edge exists between the conveyance start position Xs and the failure occurrence position X0 as described above, it is possible to more accurately determine whether or not the conveyance failure is due to the jam because there is a little chance of occurrence of the conveyance failure due to the jam when the carriage 50 moves from the inside of the sheet passing area toward the outside thereof even if the carriage 50 has moved across the outer edge of the sheet passing area.

In S300, the CPU 11 inputs a command to the carriage control portion 33 and thereby permits the carriage control portion 33 to initiate a test conveyance operation in which the image forming operation is not conducted, since the conveyance failure is not due to the jam. Here, the "test conveyance operation" means an operation in which the carriage 50 is initially conveyed in the carriage conveyance direction from the "position at which the carriage 50 has stopped upon detection of the conveyance failure" to one of opposite ends of the carriage conveyance path, thereafter the carriage 50 is conveyed to the other of the opposite ends of the carriage conveyance direction, and finally the carriage 50 is conveyed from the other of the opposite ends to the "position at which the carriage 50 has stopped upon detection of the conveyance failure". When the "test conveyance operation" is conducted, the carriage control portion 33 controls the carriage 50 to be conveyed at a constant speed lower than that when the above-indicated "image forming operation for one path" is conducted. That is, in S300, the carriage 50 is conveyed at a low speed so as to make one reciprocating movement starting from and returning back to the "position at which the carriage 50 has stopped upon detection of the conveyance failure" as a base point. After initiation of the test conveyance operation described above, the CPU 11 stands by until the conveyance failure is detected by the carriage control portion 33 or the test conveyance operation is completed (S310, S315). It is noted the carriage control portion 33 detects the conveyance failure in the test conveyance operation according to the same procedure shown in FIG. 9. However, since it is not preferable to forcibly convey the carriage 50 in a state in which the conveyance failure is once detected, the detection sensitivity of the conveyance failure is preferably set at a high level in the test conveyance operation.

Where the test conveyance operation is completed without detection of the conveyance failure (S315: Yes), the control flow goes to S320 in which the CPU 11 inputs a command to the carriage control portion 33 and to thereby permit the carriage control portion 33 to convey the carriage 50 to a restart position which is a predetermined distance upstream in the carriage conveyance direction from the failure occurrence position X0, such that the carriage 50 is disposed at the restart position. The predetermined distance between the restart position and the failure occurrence position X0 is a sufficient distance required for the carriage 50 to be placed to a constant-speed state from a stopped state. Thereafter, the CPU 11 inputs a command to the printing/motor control portion 30 and to thereby permit the printing/motor control portion 30 to restart the "image forming operation for one path" that has been suspended by the detection of the conveyance failure (S330). More specifically, the CPU 11 controls the carriage control portion 33 to convey the carriage 50 from the restart position according to the procedure shown in FIG. 9 and controls the recording unit 40 through the printing control portion 31 to execute the ink ejection operation from the failure occurrence position X0 onward, at a time point when the carriage 50 reaches the failure occurrence position X0. After the processing in S330, the control flow goes to S180.

On the other hand, where the conveyance failure is detected by the carriage control portion 33 during the test conveyance operation (S310: Yes), the control flow goes to S317 in which the CPU 11 outputs, through the user interface 21, an alarm (in the form of a sound and a message) which notifies the user of the occurrence of the conveyance failure and which prompts the user to settle the conveyance failure. In S317, the user is also notified of, through the message, a sort of the conveyance failure (as to whether the conveyance failure is due to the jam or not). Thereafter, the print control processing is ended.

In the meantime, where an affirmative judgment is obtained in S295 (S295: Yes) and the control flow accordingly goes to S340 (FIG. 5), the processing is changed depending upon whether the carriage conveyance direction at the time of detection of the conveyance failure is "forward" or "backward". More specifically, S350 is implemented where the carriage conveyance direction is "forward" while S390 is implemented where the carriage conveyance direction is "backward".

In S350, the CPU 11 controls the carriage control portion 33 to conduct processing of retreating the carriage 50 at a low speed to the home position. After initiation of the processing, the CPU 11 stands by until the conveyance failure is detected by the carriage control portion 33 or the carriage 50 reaches the home position and accordingly capping is completed (S360, S365). When the conveyance failure is detected (S360: Yes) or when the capping is completed (S365: Yes), S370 is implemented in which an alarm is outputted through the user interface 21 in the same manner as in S317. More specifically, by outputting the alarm, the user is notified of the occurrence of the conveyance failure due to the jam and is prompted to settle the jam. After the outputting of the alarm, the CPU 11 stands by until an operation signal indicating that the failure has been settled is inputted by the user through the user interface 21 (S380). When the operation signal indicative of the settlement of the failure is inputted by the user (S380: Yes), S120 is implemented in which the image forming operation is redone, from the sheet supplying operation, on the page for which the image forming operation has been suspended.

On the other hand, where the control flow goes to S390, the CPU 11 controls the carriage control portion 33 to conduct processing of retreating the carriage 50 at a low speed to the flushing position. After initiation of the processing, the CPU 11 stands by until the conveyance failure is detected by the carriage control portion 33 or the carriage 50 reaches the flushing position (S400, S405). Where the conveyance failure is detected (S400: Yes), S420 is implemented in which an alarm similar to that in S370 is outputted, and S430 is then implemented. On the other hand, where the carriage 50 reaches the flushing position (S405: Yes), S410 is implemented in which an alarm similar to that in S370 is outputted and in which the CPU 11 inputs a command to the printing control portion 31 and to thereby permit the printing control portion 31 to start a flushing operation. In other words, in the flushing operation, the ink droplets are intermittently ejected from the nozzles by the recording unit 40 so as to prevent the ink from becoming dry and thereby clogging the nozzle portion. Thereafter, the control flow goes to S430. When the control flow goes to S430, the CPU 11 stands by until the operation signal indicating that the failure has settled is inputted by the user through the user interface 21 (S430). When the operation signal is inputted (S430: Yes), the CPU 11 inputs a command to the printing control portion 31 to finish the flushing operation. After the carriage control portion 33 has been controlled such that the carriage 50 is conveyed to the home position (S450), the control flow goes to S120 in which the image forming operation is redone, from the sheet supplying operation, on the page for which the image forming operation has been suspended.

The image forming apparatus 1 according to the present embodiment has been described above. In the present embodiment, the conveyance start position Xs of the carriage 50 is stored prior to the starting of conveyance of the carriage 50 (S500). When the conveyance failure occurs, the position X of the carriage 50 at the time of the failure occurrence is stored as the failure occurrence position X0 (S580). Further, the start-point position R1 of the sheet passing area in the carriage conveyance path (i.e., the position at which the carriage 50 enters the sheet passing area from the outside) is identified prior to the starting of conveyance of the carriage 50. When the conveyance failure occurs, it is judged whether or not the carriage 50 has moved across the start-point position R1 of the sheet passing area depending upon whether the start-point position R1 of the sheet passing area is present between the conveyance start position Xs and the failure occurrence position X0 (S295). Where the carriage 50 has moved across the start-point position R1, it is judged that the occurred conveyance failure is due to the jam caused by interference between the carriage 50 and the sheet P, and the processing in S340 and the subsequent steps for dealing with the jam is executed. On the other hand, where the carriage 50 has not moved across the start-point position R1, it is judged that the occurred conveyance failure is not due to the jam, and the processing in S300 and the subsequent steps is executed. Moreover, when the conveyance failure occurs, the sort of the conveyance failure (i.e., whether the conveyance failure is due to the jam or not) is notified through the user interface 21 (S317, S370, S410, S420). According to the present embodiment, therefore, it is possible to judge with higher accuracy whether or not the conveyance failure is due to the jam, as compared with the conventional technique in which whether or not the conveyance failure is due to the jam is judged without taking account of the conveyance start position Xs. For instance, it is possible to obviate a misjudgment that the conveyance failure is due to the jam, in a situation in which the carriage 50 does not move so as to enter the inside of the sheet P from the outside thereof and accordingly the jam cannot occur or in a situation in which the conveyance start position is present within the sheet passing area and accordingly the jam cannot occur. Further, according to the present embodiment, since whether or not the conveyance failure is due to the jam can be judged with high accuracy, there is no need of taking an excessive measure when the conveyance failure occurs. More specifically, under the condition in which the jam is occurring, the failure cannot be settled until the sheet P is removed by the user, and it is needed to wait for an appropriate measure being taken by the user. On the other hand, where the conveyance failure is due to reasons other than the jam (e.g., due to stains of the guide shaft 160), there is a high possibility that the failure has temporarily occurred and will be spontaneously settled. Accordingly, where the failure no more occurs after the test conveyance operation, the conveyance control of the carriage 50 (the image forming operation) is restarted. According to the present image forming device 1, the switching of the processing as described above (i.e., the switching of the processing between S300 and S340) can be adequately conducted by taking the cause of the conveyance failure into consideration.

According to the present embodiment, when the image is formed on the sheet P by reciprocating the carriage 50 by a plurality of times of repetition of the conveyance of the carriage 50, the start-point position R1 of the sheet passing area in the carriage conveyance path is identified in the first-time conveyance, on the basis of the sheet size notified of from the external device 90. However, in the second-time and subsequent conveyance, the sheet size is identified on the basis of the result of detection of the sheet edges obtained by the media sensor 55 in the first-time conveyance, and the start-point position R1 in the sheet passing area is subsequently identified. The arrangement ensures more accurate judgment as to whether or not the conveyance failure is due to the jam, as compared with an instance in which the sort of the conveyance failure is judged trusting the sheet size notified by the user.

In the present embodiment, during the conveyance control of the carriage 50 according to the feedback control, the conveyance failure is detected where the deviation e between the actual speed V and the target speed Vr of the carriage exceeds the threshold Th. It is noted that the jam generally occurs when the carriage 50 enters the inside of the sheet P across the outer edge of the sheet P. In view of this, the threshold Th is set to a small value at each local point at which the conveyance failure due to the jam is likely to occur, thereby enabling the conveyance failure to be detected with high sensitivity at each local point at which the conveyance failure due to the jam is likely to occur. Accordingly, it is possible to restrain the jam from becoming worse to cause damaging of the nozzle surface of the recording unit 40. Further, the detection sensitivity is made low at each local point at which the conveyance failure due to the jam does not occur, so as to restrain detection of the conveyance failure caused by a slight increase in the conveyance load due to the stains of the guide shaft 160 and the like. Therefore, it is possible to restrain the user from feeling dissatisfied due to excessive detection of the conveyance failure. In an electronic device configured to detect the conveyance failure where the deviation exceeds the threshold, the conveyance failure will be undesirably detected also when the conveyance load is increased due to adhesion of the stains to the guide shaft that regulates the moving direction of the carriage, for instance. By applying the concept of the present invention to such an electronic device, however, it is possible to appropriately judge whether or not the detected conveyance failure is attributed to the jam. According to the present embodiment, where the conveyance failure due to the jam occurs, the recording unit 40 is retreated so as to be conveyed to the capping position or the flushing position. Accordingly, the recording unit 40 can be kept in a better state, as compared with an instance in which the carriage 50 is kept halted at the position at which the conveyance failure has occurred until the jam is settled. The arrangement restrains the ink that adhered to the nozzle portion from being solidified and thereby clogging the nozzle portion. Where the carriage 50 is forced to be continuously conveyed when the jam occurs, the nozzle portion of the recording unit 40 may be undesirably damaged. However, by retreating the carriage 50 as described above when the jam occurs, such a problem can be avoided.

In the present embodiment, a controller is constituted by a failure detecting portion, a position detecting portion, a conveyance start position storage portion, a failure occurrence position identifying portion, an outer-edge position identifying portion, a jam judging portion, an image-formation suspending portion, a failure handling portion, and an image forming portion. The failure detecting portion is realized by the operation, by the carriage control portion 33, of detecting the reversing failure, the stopping failure, or the speed reduction failure. The position detecting portion is realized by the signal processing portion 34 configured to process the signals of the linear encoder 65. The conveyance start position storage portion is realized by the processing in S500 executed by the carriage control portion 33. The failure occurrence position identifying portion is realized by the processing in S580 executed by the carriage control portion 33. The outer-edge position identifying portion is realized by the operation of identifying the sheet size in S110 and S210 and the operation of identifying the start-point position of the sheet passing area in S140 and S220, which operations are executed by the CPU 11. The jam judging portion is realized by the processing in S290 and S295. The image-formation suspending portion is realized by the processing in S590. The failure handling portion is realized by the processing in S350 and S390. The image forming portion is realized by the processing in S170, S240 and so on.

Figure 8C:
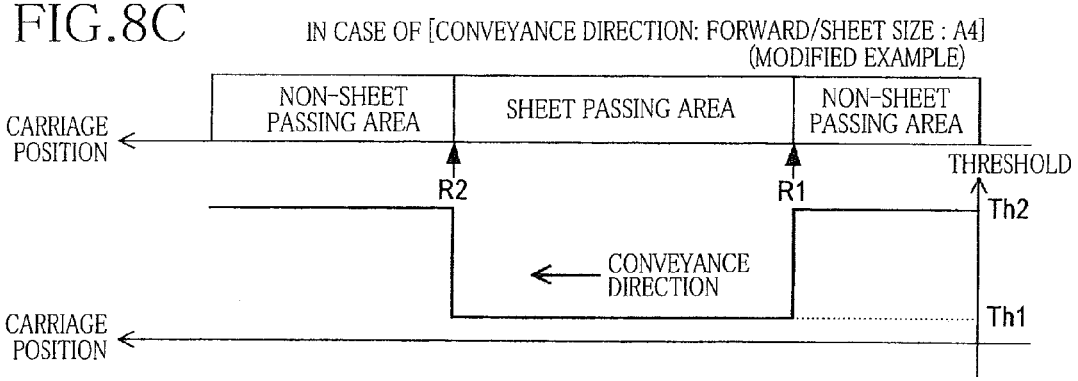

In the image forming device 1 to which the concept of the present invention is applied, it is possible to accurately judge whether or not the conveyance failure of the carriage 50 which occurs in the process of the image forming operation is due to the jam. It is noted that the invention is not limited to the illustrated embodiment, but may be otherwise embodied. For instance, the present invention is applicable to other electronic device such as a facsimile machine. Further, the above-indicated threshold Th may be set according to a technique shown in FIG. 8C. More specifically, the first threshold Th1 may be set for the entirety of the sheet passing area and the second threshold Th2 may be set for the entirety of the non-sheet passing area. FIG. 8C is a diagram for explaining a modified example of setting the threshold Th where the carriage conveyance direction is "forward". Further, the carriage control portion 33 may be configured to detect the conveyance failure depending upon whether or not the operation amount u (control input) derived from the deviation e exceeds the failure judgment value. Moreover, the detection of the conveyance failure utilizing the operation amount u is equivalent to detection of the conveyance failure utilizing the drive voltage or the drive current. Accordingly, the image forming device 1 may be configured to detect the conveyance failure utilizing the drive voltage or the drive current of the CR motor 60. Where the carriage 50 is conveyed according to a position control, the operation amount u may be determined by obtaining a deviation e between a target position and an actual position of the carriage 50, and the image forming device 1 may be configured to detect the conveyance failure by comparison between the deviation e or the operation amount u and the threshold Th.

The identification of the sheet size by the media sensor 55 may be conducted prior to initiation of the printing operation, not during the printing operation. In other words, after the sheet P has passed below the carriage 50 and reached the image-formation start portion, the carriage 50 may be scanned without ejecting the ink and the outer edges of the sheet P may be identified by the media sensor 55. In the present embodiment, where the speed failure occurs in the acceleration or deceleration section in S280, it is judged that the conveyance failure is not due to the jam. However, the judgments in S290 and S295 may be conduced also in the acceleration or deceleration section. That is, since the carriage 50 passes the start-point position R1 of the sheet passing area in the acceleration or deceleration section, depending upon the recording conditions, there is a possibility of occurrence of the jam in the midst of the acceleration or deceleration operation of the carriage 50. Therefore, the judgment as to whether or not the conveyance failure is due to the jam may be conducted in any speed section, without conducting the judgment in S280. Moreover, the speed reduction failure may be detected as the conveyance failure in the acceleration or deceleration section as in the constant-speed section.

What is claimed is:

1. An electronic device, comprising:

a carriage conveyance mechanism configured to convey a carriage in a main scanning direction;

a sheet conveyance mechanism configured to convey a sheet in a sub scanning direction that intersects the main scanning direction; and a controller configured to control operations of the electronic device and including:

a failure detecting portion configured to detect a conveyance failure of the carriage;

a position detecting portion configured to detect a position of the carriage on a carriage conveyance path through which the carriage is conveyed by the carriage conveyance mechanism;

a conveyance start position storage portion configured to store, on the basis of a result of detection by the position detecting portion, a conveyance start position of the carriage at a time when the carriage conveyance mechanism starts to convey the carriage at a standstill in the main scanning direction;

a failure occurrence position identifying portion configured to identify, on the basis of a result of detection by the position detecting portion, a failure occurrence position that is a position of the carriage at a time when the failure detecting portion detects the conveyance failure;

an outer-edge position identifying portion configured to identify a position of an outer edge of a sheet passing area which is an area in the carriage conveyance path and which faces an area in which the sheet conveyed by the sheet conveyance mechanism in the sub scanning direction passes; and a jam judging portion configured to judge whether or not the conveyance failure detected by the failure detecting portion is due to a jam of the sheet, wherein the jam judging portion is configured to judge that the conveyance failure detected by the failure detecting portion is due to the jam where the outer-edge position identified by the outer-edge position identifying portion is present between the conveyance start position stored by the conveyance start position storage portion and the failure occurrence position identified by the failure occurrence position identifying portion.

2. The electronic device according to claim 1, wherein the jam judging portion is configured to judge that the conveyance failure detected by the failure detecting portion is not due to the jam where the outer-edge position is not present between the conveyance start position and the failure occurrence position.

3. The electronic device according to claim 1, wherein the outer-edge position identifying portion is configured to identify, as the position of the outer edge of the sheet passing area, a position of an upstream-side one of two outer edges of the sheet passing area in a carriage conveyance direction in which the carriage is conveyed by the carriage conveyance mechanism, and wherein the jam judging portion is configured to judge that the conveyance failure detected by the failure detecting portion is due to the jam where the position of the upstream-side one of the two outer edges identified by the outer-edge position identifying portion is present between the conveyance start position and the failure occurrence position.

4. The electronic device according to claim 1, wherein the outer-edge position identifying portion is configured to obtain size information of the sheet conveyed by the sheet conveyance mechanism and to identify the position of the outer edge of the sheet passing area on the basis of the size information.

5. The electronic device according to claim 1, wherein the carriage is equipped with a media sensor capable of detecting an outer edge of the sheet, and wherein the outer-edge position identifying portion is configured to identify the position of the outer edge of the sheet passing area on the basis of a detection signal by the media sensor.

6. The electronic device according to claim 1, wherein the carriage conveyance mechanism is configured to convey the carriage in the main scanning direction by a drive force of a motor, wherein the controller further includes a carriage control portion configured to control the carriage conveyance mechanism to convey the carriage in the main scanning direction according to a feedback control in which one of a drive voltage and a drive current to be inputted to the motor is determined on the basis of a deviation between: one of an actual speed and an actual position of the carriage in the main scanning direction; and a corresponding one of a target speed and a target position and in which the one of the actual speed and the actual position is conformed to the corresponding one of the target speed and the target position, and wherein the failure detecting portion is configured to detect the conveyance failure where one of: (a) the deviation; and (b) one of the drive voltage and the drive current exceeds a threshold.

7. The electronic device according to claim 6, wherein the threshold is determined for each of local points on the carriage conveyance path, and wherein the threshold for each of the local points within the sheet passing area on the carriage conveyance path is smaller than the threshold for each of the local points outside the sheet passing area.

8. The electronic device according to claim 6, wherein the threshold is determined for each of local points on the carriage conveyance path, and wherein the threshold for a local point corresponding to the outer edge of the sheet passing area on the carriage conveyance path is smaller than the threshold for each of the other local points.

9. The electronic device according to claim 1, wherein the failure detecting portion is configured to detect the conveyance failure of the carriage where, when the carriage conveyance mechanism conveys the carriage from the conveyance start position, the carriage is retreated in a direction opposite to a carriage conveyance direction in which the carriage is conveyed by the carriage conveyance mechanism.

10. The electronic device according to claim 1, wherein the electronic device is an image forming device in which a recording unit configured to eject ink droplets to the sheet is mounted on the carriage, and wherein the controller further comprises an image forming portion configured to control the carriage conveyance mechanism to reciprocate the carriage in the main scanning direction, to control the sheet conveyance mechanism to convey the sheet in the sub scanning direction, and to control the recording unit to eject the ink droplets during a movement of the carriage in the main scanning direction, when an image forming command is inputted, so as to realize an image forming operation in which an image designated by the image forming command is formed on the sheet.

11. The electronic device according to claim 10, wherein the controller further includes:

an image-formation suspending portion configured to suspend an image forming operation by the image forming portion where the conveyance failure is detected by the failure detecting portion; and a failure handling portion configured to control the carriage conveyance mechanism to convey the carriage in an opposite direction which is opposite to a prescribed direction at the time of occurrence of the conveyance failure where the failure detecting portion detects the conveyance failure and the jam judging portion judges that the conveyance failure is due to the jam.

12. The electronic device according to claim 11, further comprising: a capping mechanism which is disposed at one of opposite ends of the carriage conveyance path and which is configured to cap a nozzle portion of the recording unit from which the ink droplets are ejected; and a flushing mechanism which is disposed at the other of the opposite ends of the carriage conveyance path and which is configured to accumulate the ink droplets ejected by a flushing operation of the recording unit, wherein the failure handling portion is configured to control the carriage conveyance mechanism to convey the carriage in the opposite direction such that the recording unit is disposed at one of the capping mechanism and the flushing mechanism.

* * * * *